US011040820B2

(12) United States Patent
Dong

(10) Patent No.: US 11,040,820 B2
(45) Date of Patent: Jun. 22, 2021

(54) THERMAL BAG

(71) Applicant: XIAMEN KINGQUEEN INDUSTRIAL CO., LTD., Fujian (CN)

(72) Inventor: Jinfei Dong, Xiamen (CN)

(73) Assignee: XIAMEN KINGQUEEN INDUSTRIAL CO., LTD., Fujian (CN)

( * ) Notice: Subject to any disclaimer, the term of this patent is extended or adjusted under 35 U.S.C. 154(b) by 157 days.

(21) Appl. No.: 16/264,630

(22) Filed: Jan. 31, 2019

(65) Prior Publication Data

US 2020/0172318 A1 Jun. 4, 2020

(30) Foreign Application Priority Data

Dec. 4, 2018 (CN) ..... 201822027020.4

(51) Int. Cl.
*B65D 81/38* (2006.01)
*B65D 33/25* (2006.01)
*B65D 33/10* (2006.01)

(52) U.S. Cl.
CPC ..... *B65D 81/3897* (2013.01); *B65D 33/2591* (2013.01); *B65D 81/389* (2013.01); *B65D 33/105* (2013.01)

(58) Field of Classification Search
CPC ..... A45C 13/007; A45C 13/06; A45C 13/103; A45C 13/1076; A45C 13/34; B65D 29/02; B65D 49/02; B65D 81/2038; B65D 81/38; B65D 81/3888; B65D 81/3897; F25D 2323/062; F25D 3/08; F25D 2331/801–8051
See application file for complete search history.

(56) References Cited

U.S. PATENT DOCUMENTS 2,144,481 A * 1/1939 Bryant ..... E05D 5/04 220/829
2,264,085 A * 11/1941 Loos ..... A44B 19/34 190/119
4,006,868 A * 2/1977 Hochradel ..... B65G 51/06 406/186
6,427,475 B1 * 8/2002 DeFelice ..... F25D 3/08 62/457.2
6,513,672 B1 * 2/2003 Ovadia ..... A45C 11/06 206/6.1

FOREIGN PATENT DOCUMENTS

FR 626717 A * 9/1927 ..... A45C 13/103

* cited by examiner

*Primary Examiner* — Mollie Impink
(74) *Attorney, Agent, or Firm* — Leong C. Lei

(57) ABSTRACT

A thermal bag includes a thermal bag main body and an upper cover. A side shaping board is interlaid between the fabrics around the thermal bag main body. The upper cover includes a pair of half covers. An opening assembly is connected between the two half covers. Atop shaping board is interlaid between the fabrics of each of the half covers. A hinge assembly is connected between the side shaping board and the top shaping board located at the same side of the opening assembly. The hinge assembly drives the half covers to open/close the opening of the thermal bag quickly.

5 Claims, 8 Drawing Sheets

THERMAL BAG

BACKGROUND OF THE INVENTION

1. Field of the Invention

The present invention relates to a thermal bag, and more particularly to a thermal bag that is opened/closed conveniently.

2. Description of the Prior Art

A thermal bag is widely used in our daily life, especially in the field of takeout and medicine. Compared with a common bag, the inner layer of the thermal bag is made of aluminum foil. Through PE cotton having thermal insulation function, the bag has a short-term thermal insulation effect to store various foods and maintain the temperature and freshness of the foods. The medical personnel may use the thermal bag for carrying some medicines that need to be kept in a constant temperature environment when going out.

In general, the thermal bag is made of Oxford fabric or nylon fabric, and the opening portion of the thermal bag is soft. As a result, the shape of the opening is irregular after the opening is opened. It is inconvenient to take and place articles. The joint between the upper cover portion and the main body portion of the thermal bag has no stable structure, so it is also soft, resulting in an unstable shape of the upper cover.

Accordingly, the inventor of the present invention has devoted himself based on his many years of practical experiences to solve these problems.

SUMMARY OF THE INVENTION

The primary object of the present invention is to provide a thermal bag which has the characteristics of convenient opening and closing. An upper cover of the thermal bag has a stable shape to facilitate the placement of articles.

In order to achieve the above object, the present invention adopts the following technical solutions.

A thermal bag comprises a thermal bag main body, an upper cover, and an opening assembly. The upper cover is connected to an opening of the thermal bag main body. A side shaping board is interlaid between an outer layer fabric and an inner layer fabric around the thermal bag main body. The upper cover includes a pair of half covers that are disposed symmetrically. The opening assembly is connected between the two half covers for opening or closing the opening between the two half covers. Atop shaping board is interlaid between an outer layer fabric and an inner layer fabric of each of the half covers for supporting the fabrics of the half covers. A hinge assembly is connected between the side shaping board and the top shaping board located at the same side of the opening assembly. The hinge assembly includes a limiting member and two opening-closing plates connected to the top shaping bard and the side shaping board, respectively. The two opening-closing plates are hinged to a rotating shaft and disposed symmetrically with the rotating shaft as a center line. The limiting member includes a curved portion and two hooks at two ends of the curved portion. A front of each of the opening-closing plates has at least one groove for engagement of a corresponding one of the hooks. A distance between the two hooks is less than twice a distance between the groove and the rotating shaft. The limiting member is located at backs of the two opening-closing plates. The hooks extend over sides of the opening-closing plates and are engaged in the grooves of the opening-closing plates. The rotating shaft leans against the curved portion.

Preferably, a support bar is interlaid between the outer layer fabric and the inner layer fabric of each of the half covers. The support bar is located between the top shaping board and the opening assembly. The support bar extends in the direction of the opening assembly.

Preferably, the two support bars of the two half covers extend to a position beyond a side wall of the thermal bag main body. Ends of the two support bars are bent toward each other, directed to ends of the opening assembly.

Preferably, the side shaping board and the top shaping board are foam boards.

Preferably, the opening assembly is a zipper.

With the above structure, after opening/closing the opening assembly of the present invention, the half covers are opened/closed manually, so that the hinge assembly is in an intermediate state. The hinge assembly drives the half covers to be opened/closed in the maximum opening/closing state, so as to facilitate quick opening and closing of the thermal bag.

In addition, the support bars are configured to brace the fabrics on both sides of the opening assembly for articles to be placed into or taken out from the thermal bag conveniently. The top shaping boards increase the ability of the fabrics of the upper over to be shaped while increasing the thermal insulation function.

DETAILED DESCRIPTION OF THE PREFERRED EMBODIMENTS

Embodiments of the present invention will now be described, by way of example only, with reference to the accompanying drawings.

Figure 1:
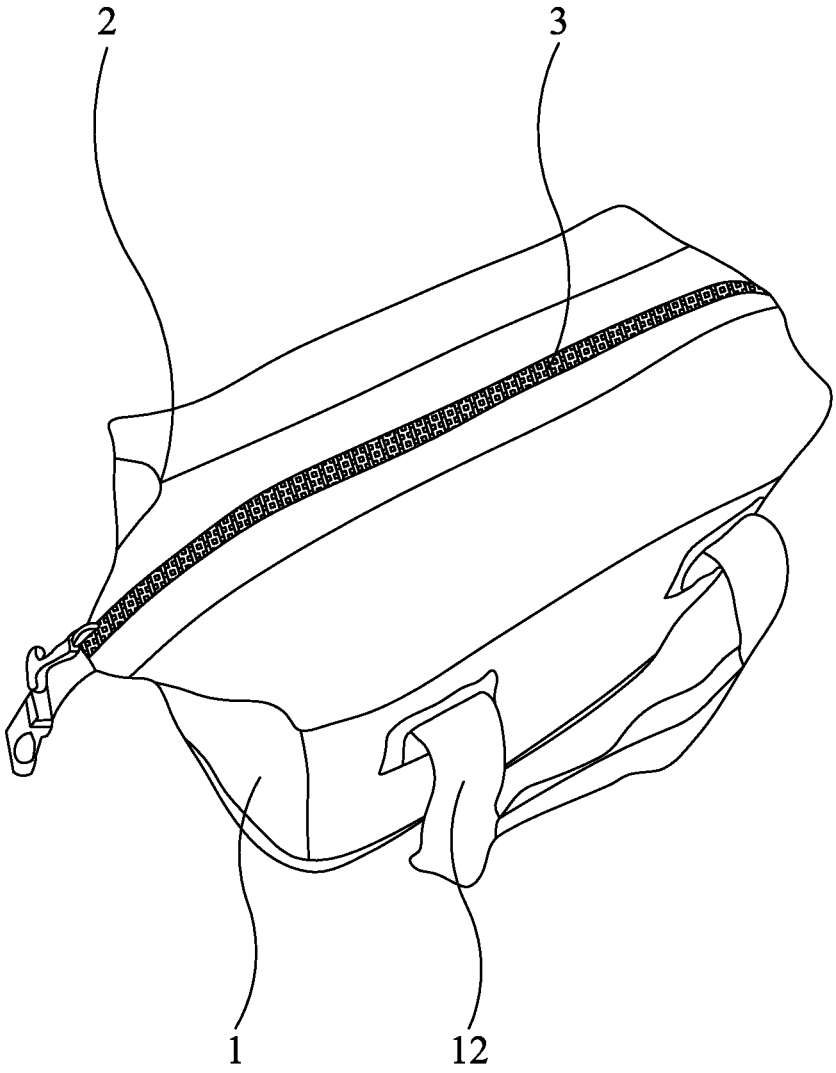
FIG. 1 is a perspective view of a preferred embodiment of the present invention.
Figure 2:
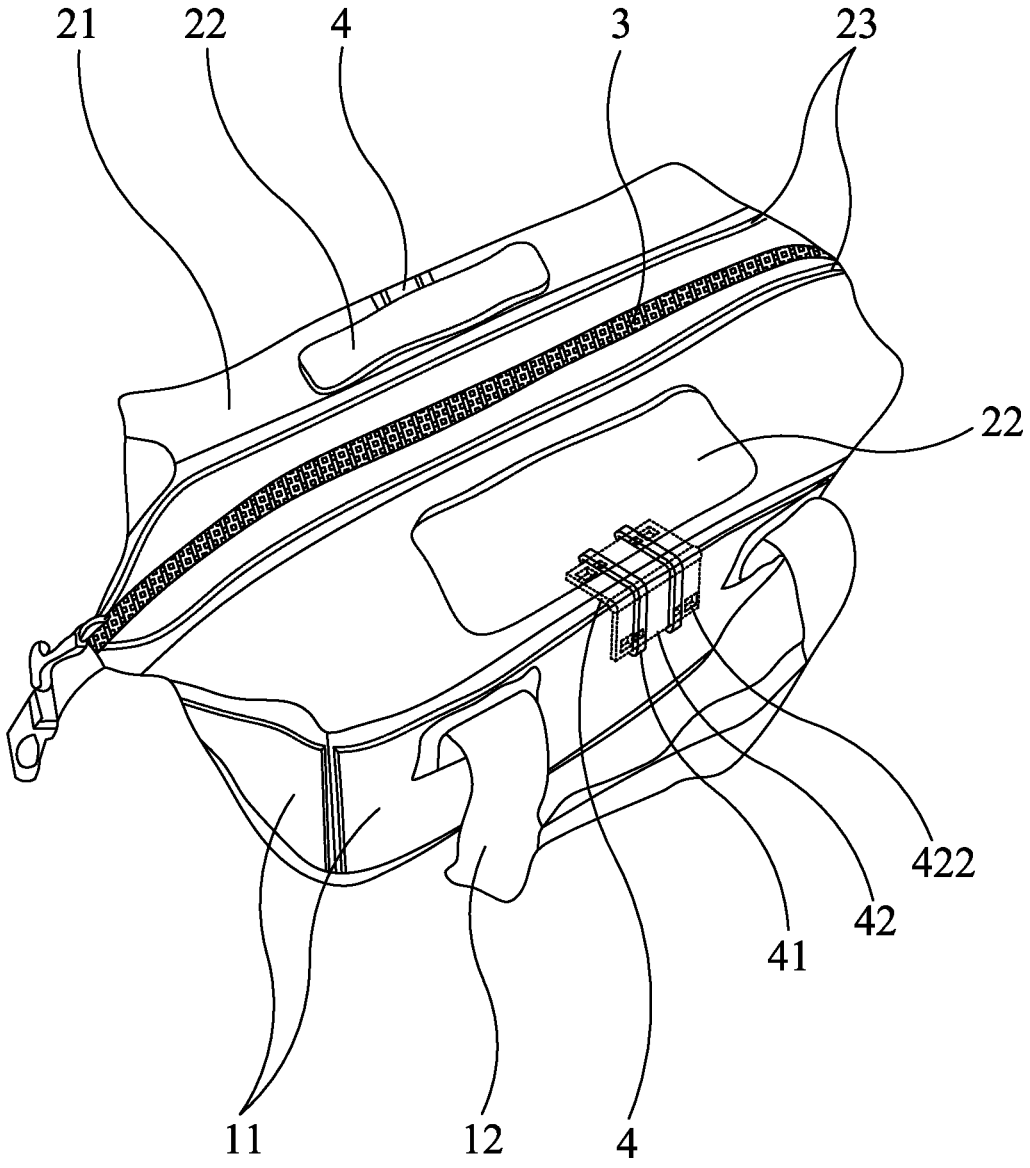
FIG. 2 is a schematic view of the preferred embodiment of the present invention in a closed state.

As shown in FIG. 1 and FIG. 2, a thermal bag comprises a thermal bag main body 1, an upper cover 2, and an opening assembly 3. The thermal bag main body 1 is in the shape of a bag which is common in our daily life, and has a cavity therein for storing articles. The upper cover 2 is connected to the opening of the thermal bag main body 1 so that the cavity between the two becomes a storage space that can be opened and closed.

A side shaping board 11 is interlaid between an outer layer fabric and an inner layer fabric around the thermal bag main body 1 for the thermal bag main body 1 to have a regular cylindrical shape, so that it is more convenient for the internal cavity to store articles, not in a state of chaos. A pair of handles 12 is mounted on two opposite sides of the outer wall of the thermal bag main body 1 for moving and carrying the thermal bag.

The upper cover 2 includes a pair of half covers 21 that are disposed symmetrically. The opening assembly 3 is connected between the two half covers 21 for opening or closing the opening between the two half covers 21, that is, for opening or closing the cavity. The opening assembly 3 of the present invention is a zipper. The opening assembly 3 may be magnetic strips that are able to attract each other and are disposed on the corresponding sides of the two half covers 21, so as to open or close the opening of the thermal bag. A top shaping board 22 is interlaid between an outer layer fabric and an inner layer fabric of each of the half covers 2 for supporting the fabrics of the half covers 21. The top shaping board 22 can support most of the fabrics of the half covers 21 to be in a regular shape.

Figure 3:
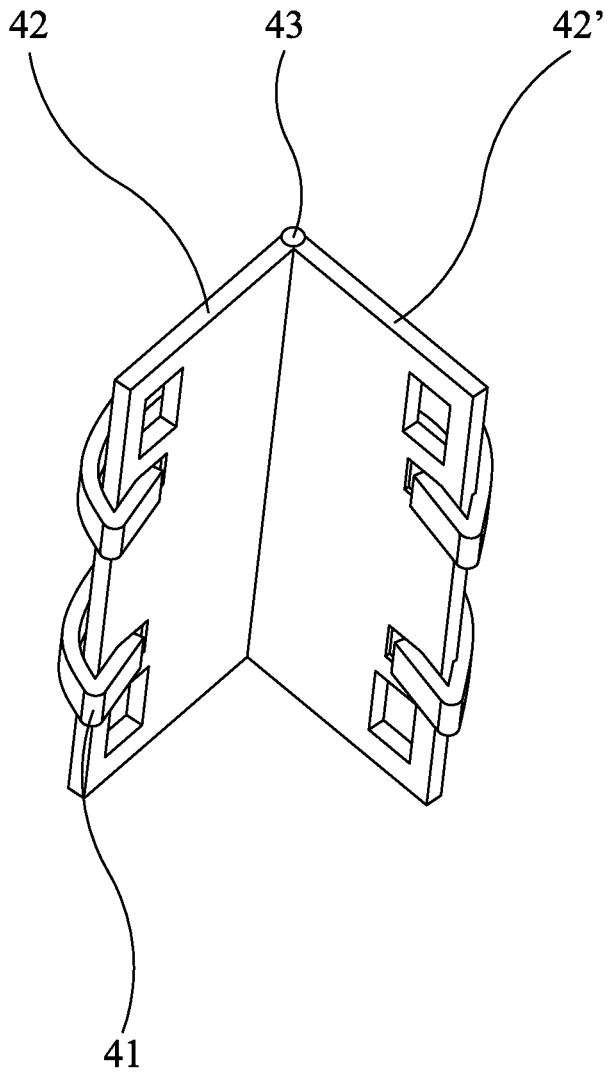
FIG. 3 is a perspective view of the hinge assembly of the present invention.
Figure 4:
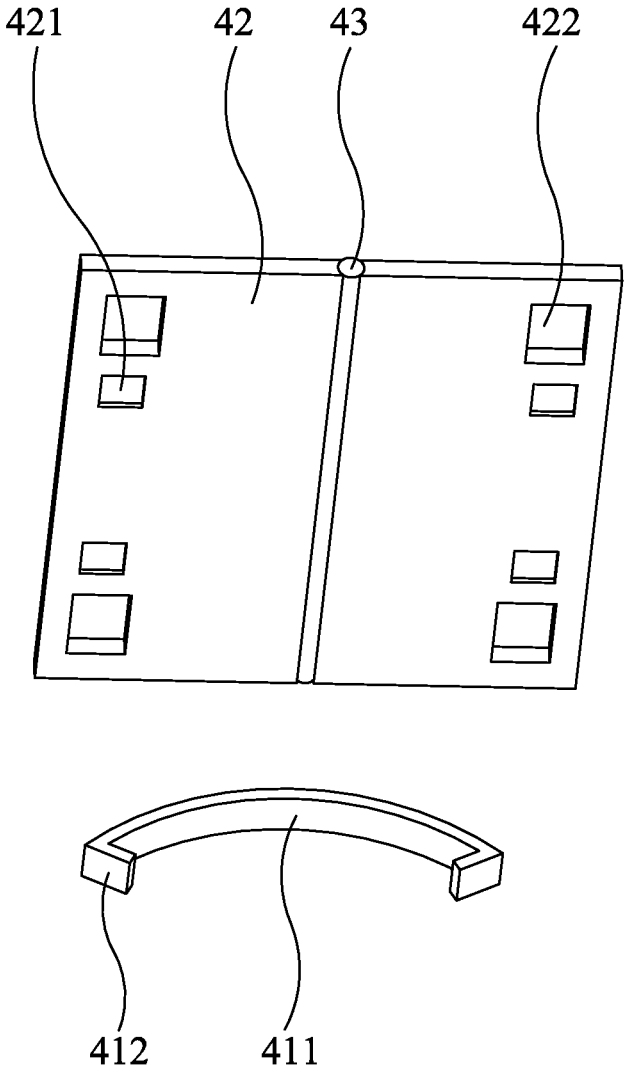
FIG. 4 is an exploded view of the hinge assembly of the present invention.
Figure 5:
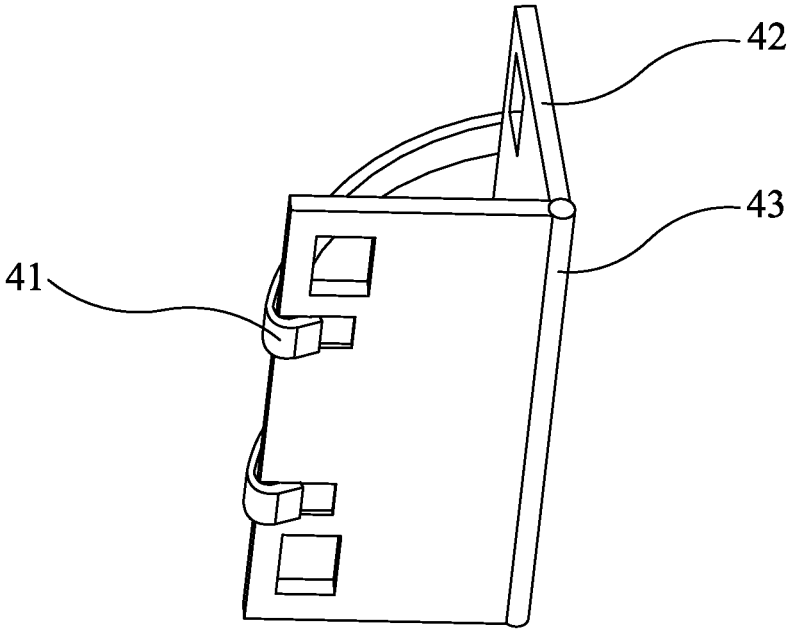
FIG. 5 is a schematic view of the hinge assembly of the present invention in an open state.

A hinge assembly 4 is connected between the side shaping board 11 and the top shaping board 22 located at the same side of the opening assembly 3, as shown in FIG. 3 to FIG. 5. The hinge assembly 4 includes a limiting member 41 and two opening-closing plates 42 connected to the top shaping bard 22 and the side shaping board 11, respectively. The two opening-closing plates 42 are hinged to a rotating shaft 43 and disposed symmetrically with the rotating shaft 43 as a center line, so that one of the opening-closing plates 42 can rotate at any angle relative to the other opening-closing plates 42' with the rotating shaft 43 as an axis. The limiting member 41 includes a curved portion 411 and two hooks 412 at two ends of the curved portion 411. The front of each opening-closing plate 42 has at least one groove 421 for engagement of a corresponding one of the hooks 412. The distance between the two hooks 412 is less than twice the distance between the groove 421 and the rotating shaft 43. When the two hooks 412 are fitted in the grooves 421 of the two opening-closing plates 42 respectively, the angle between the two opening-closing plates 42 is less than 180°. The limiting member 41 is located at the backs of the two opening-closing plates 42. The hooks 412 extend over the sides of the opening-closing plates 42 and are engaged in the grooves 421 of the opening-closing plates 42. The rotating shaft 43 leans against the curved portion 411. Each opening-closing plate 42 has at least one mounting hole 422. The opening-closing plate 42 is connected to the side shaping board 11 or the top shaping board 22 through the mounting hole 422.

In this embodiment, the hinge assembly 4 includes two limiting members 41, and each of the opening-closing plates 42 has two grooves 421 for the structure to be more stable.

Figure 6:
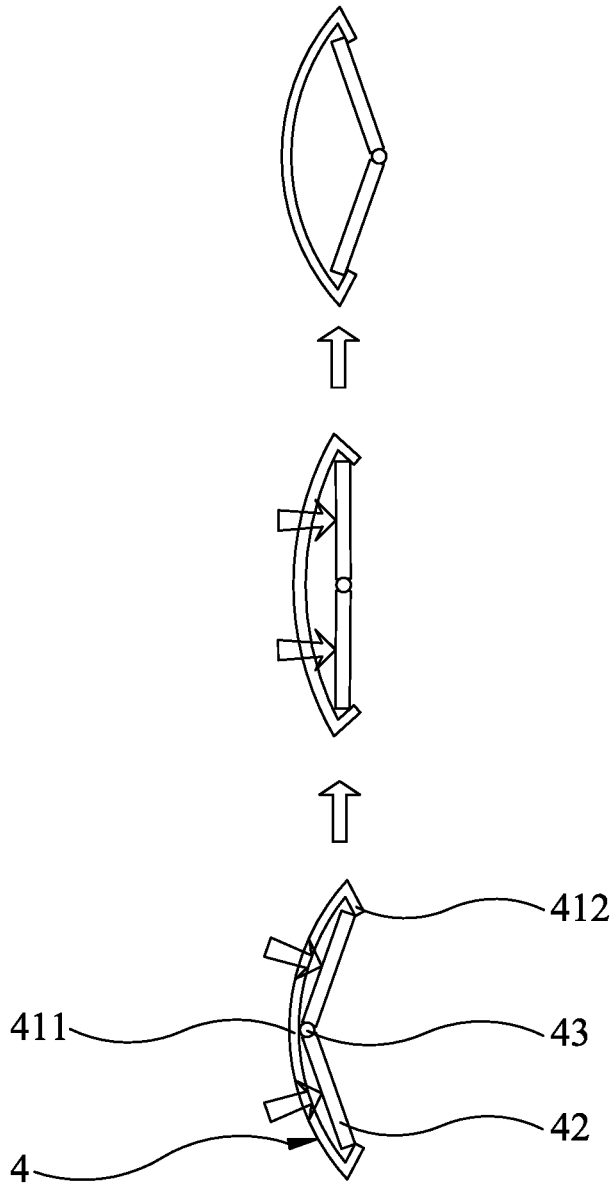
FIG. 6 is a schematic view showing that the hinge assembly changes from a closed state to an open state.
Figure 7:
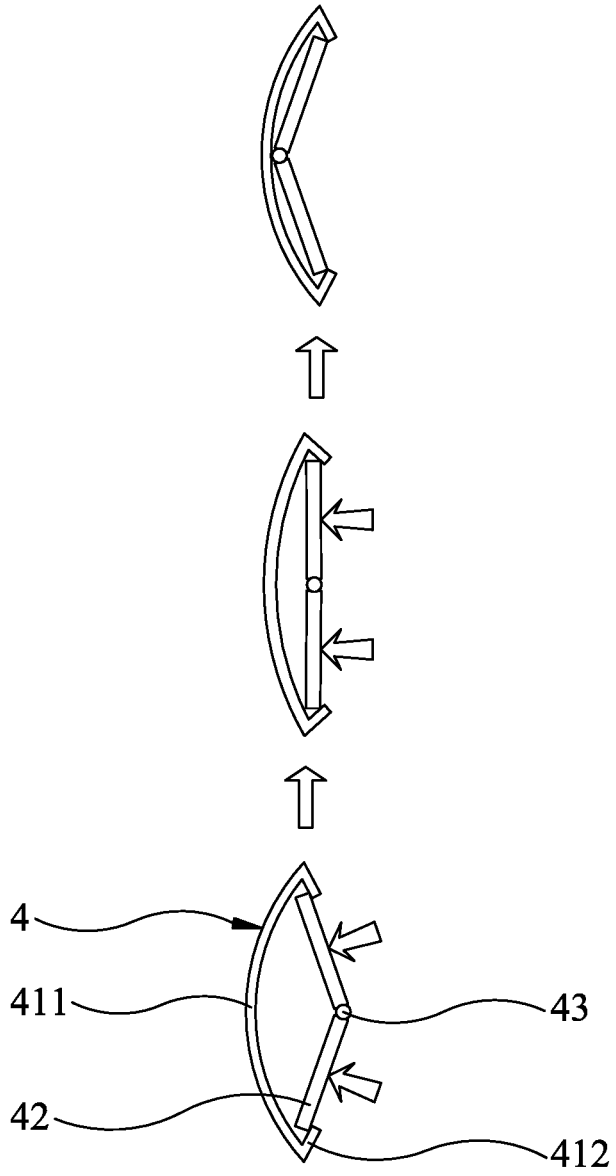
FIG. 7 is a schematic view showing that the hinge assembly changes from an open state to a closed state.

FIG. 6 and FIG. 7 illustrate the change of the hinge assembly 4 during operation. When the hinge assembly 4 is in a closed state, a force is applied to the backs of the opening-closing plates 42 until the two opening-closing plates 42 are pushed to be in an intermediate state in the same plane, and the limiting member 41 is stretched. At this time, the two opening-closing plates 42 are slightly applied with a force until an obtuse angle is formed between the two opening-closing plates 42. The elastic force of the limiting member 41 enables the two opening-closing plates 42 to continue to turn with the rotating shaft 43 as an axis until the two opening-closing plates 42 are in an open state, and the limiting member 41 returns to the original shape. When the hinge assembly 4 is in an open state, a force is applied to the fronts of the opening-closing plates 42 until the two opening-closing plates 42 are pushed to be in an intermediate state in the same plane, and the limiting member 41 is stretched. At this time, the two opening-closing plates 42 are slightly applied with a force until an obtuse angle is formed between the two opening-closing plates 42. The elastic force of the limiting member 41 enables the two opening-closing plates 42 to continue to turn with the rotating shaft 43 as an axis until the rotating shaft 43 leans against the curved portion 411, and the limiting member 41 returns to the original shape.

Figure 8:
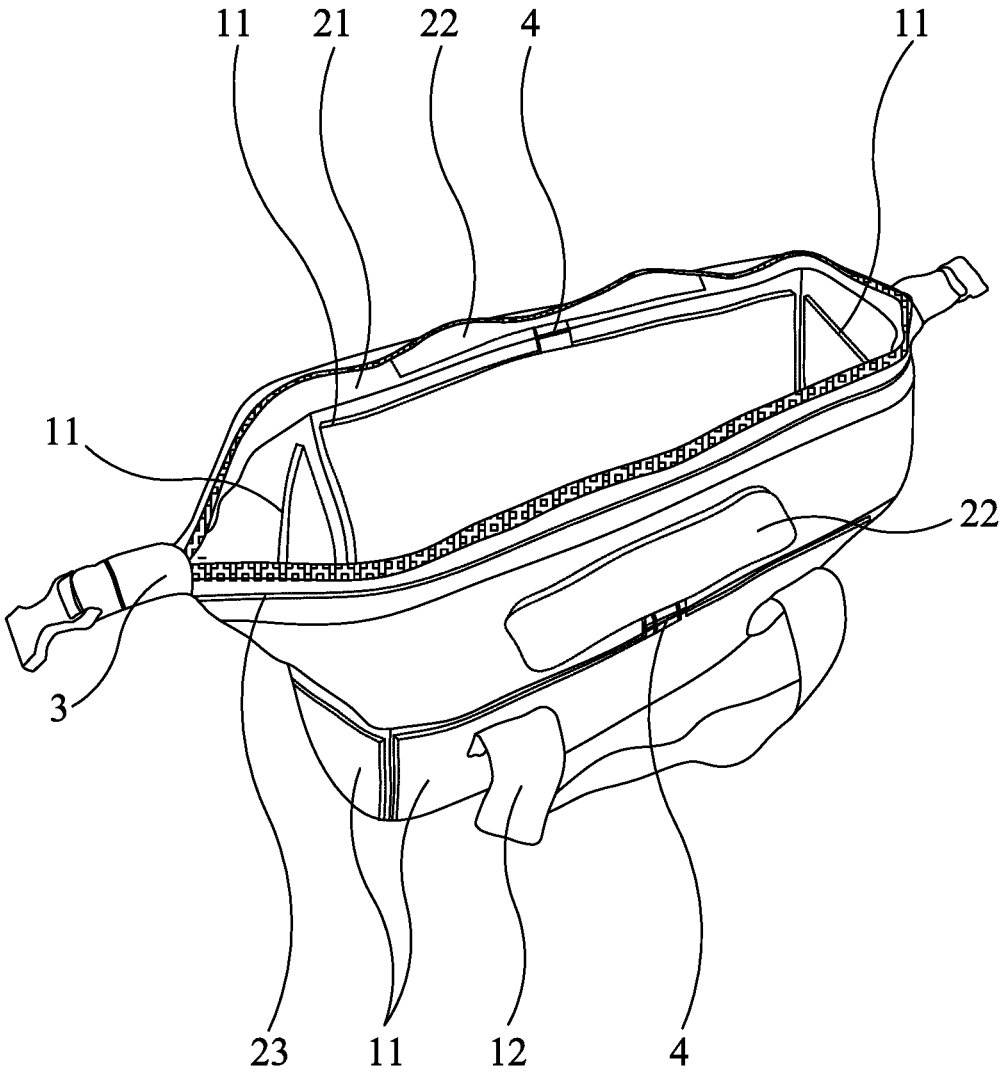
FIG. 8 is a schematic view of the preferred embodiment of the present invention in an open state.

A support bar 23 is interlaid between the outer layer fabric and the inner layer fabric of each of the half covers 2. The support bar 23 is located between the top shaping board 22 and the opening assembly 3. The support bar 23 extends in the direction of the opening assembly 3. The two support bars 23 of the two half covers 21 extend to a position beyond the side wall of the thermal bag main body 1, the ends of the two support bars 23 are bent toward each other, directed to the ends of the opening assembly 3. As shown in FIG. 8, the support bars 23 are configured to support the fabrics at both sides of the opening assembly 3, so that the opening of the opening assembly 3 after opened has a stable shape for the articles to be placed into or taken out from the thermal bag conveniently.

The side shaping board 11 and the top shaping board 22 may be a foam board which is common in our daily life, and they are light and practical.

When the opening of the opening assembly 3 is closed, the two support bars 23 and the top shaping bards 22 jointly support the fabrics of the upper cover 2, and the hinge assembly 4 is in a closed state, so that the bag has a flat top surface. When the opening of the opening assembly 3 is opened, the two support bars 23 cooperate with each other to brace the fabrics at the opening. The top shaping boards 22 are forced to move toward both sides of the thermal bag main body 1, that is, the backs of the opening-closing plates 42 are applied with a force. The hinge assembly 4 is changed to be in an open state, and the opening is opened quickly to be in an open state. The current shape is kept stable, without collapsing, which is more convenient for taking and placing articles. When the upper cover 2 needs to be closed, the top shaping boards 22 are forced to move toward each other, that is, the fronts of the opening-closing plates 42 are applied with a force. The hinge assembly 4 is changed to be in a closed state, and the opening is closed quickly.

With the above structure, after opening/closing the opening assembly 3 of the present invention, the half covers 21 are opened/closed manually, so that the hinge assembly 4 is in an intermediate state. The hinge assembly 4 drives the half covers 21 to be opened/closed in the maximum opening/closing state, facilitating quick opening and closing of the opening assembly 3.

In addition, the support bars 23 are configured to brace the fabrics at both sides of the opening assembly 3 for the articles to be placed into or taken out from the thermal bag conveniently. The top shaping boards 22 increase the ability of the fabrics of the upper over 2 to be shaped while increasing the thermal insulation function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A thermal bag, comprising a thermal bag main body, an upper cover and an opening assembly, the upper cover being connected to an opening of the thermal bag main body; a side shaping board being interlaid between an outer layer fabric and an inner layer fabric around the thermal bag main body, the upper cover including a pair of half covers that are disposed symmetrically, the opening assembly being connected between the two half covers for opening or closing the opening between the two half covers; a top shaping board being interlaid between an outer layer fabric and an inner layer fabric of each of the half covers for supporting the fabrics of the half covers; a hinge assembly being connected between the side shaping board and the top shaping board located at a same side of the opening assembly, the hinge assembly including a limiting member and two opening-closing plates connected to the top shaping board and the side shaping board respectively, the two opening-closing plates being hinged to a rotating shaft and disposed symmetrically with the rotating shaft as a center line; the limiting member including a curved portion and two hooks at two ends of the curved portion, a front of each of the opening-closing plates having at least one groove for engagement of a corresponding one of the hooks;

wherein a distance between the two hooks is less than twice a distance between the groove and the rotating shaft in a closed state of the hinge assembly, and the distance varies with elastic deformation of the curved portion to enable the hinge assembly to change from the closed state to an open state through movement of the two opening-closing plates relative to the center line of the rotating shaft; and the curved portion of the limiting member is located at backs of the two opening-closing plates, the hooks two ends of the curved portion respectively extending over edges of the opening-closing plates that are distant from the rotating shaft and the hooks at the two ends of the curved portion being respectively located at the fronts of the opening-closing plates and engaged in the grooves of the fronts of the opening-closing plates, so that, in the closed state, the two opening-closing plates are enclosed between the two hooks and the curved portion and the rotating shaft leans against the curved portion.

2. The thermal bag as claimed in claim 1, wherein a support bar is interlaid between the outer layer fabric and the inner layer fabric of each of the half covers, the support bar is located between the top shaping board and the opening assembly, and the support bar extends in the direction of the opening assembly.

3. The thermal bag as claimed in claim 2, wherein the two support bars of the two half covers extend to a position beyond a side wall of the thermal bag main body, and ends of the two support bars are bent toward each other, directed to ends of the opening assembly.

4. The thermal bag as claimed in claim 1, wherein the side shaping board and the top shaping board are foam boards.

5. The thermal bag as claimed in claim 1, wherein the opening assembly is a zipper.

* * * * *